US006200208B1

(12) United States Patent
Andrews et al.

(10) Patent No.: US 6,200,208 B1
(45) Date of Patent: Mar. 13, 2001

(54) SUPERABRASIVE WHEEL WITH ACTIVE BOND

(75) Inventors: Richard M. Andrews, Westborough; Sergej-Tomislav Buljan, Acton; Srinivasan Ramanath, Holden; Earl G. Geary, Framingham, all of MA (US)

(73) Assignee: Norton Company, Worcester, MA (US)

( * ) Notice: Subject to any disclaimer, the term of this patent is extended or adjusted under 35 U.S.C. 154(b) by 0 days.

(21) Appl. No.: 09/227,028

(22) Filed: Jan. 7, 1999

(51) Int. Cl.[7] ..... B28D 1/00
(52) U.S. Cl. ..... 451/548; 451/541
(58) Field of Search ..... 451/544, 541, 451/548; 51/297

(56) References Cited

U.S. PATENT DOCUMENTS

| | | | | |
|---|---|---|---|---|
| Re. 21,165 | | 7/1939 | Van der Pyl | 51/280 |
| 2,238,351 | | 4/1941 | Van der Pyl | 51/309 |
| 2,828,197 | | 3/1958 | Blackmer, Jr. | 51/309 |
| 3,779,726 | | 12/1973 | Fisk et al. | 51/295 |
| 3,886,925 | | 6/1975 | Regan | 125/15 |
| 3,894,673 | | 7/1975 | Lowder et al. | 228/122 |
| 3,923,558 | | 12/1975 | Shapiro et al. | 148/32.5 |
| 3,925,035 | | 12/1975 | Keat | 51/309 |
| 4,180,048 | | 12/1979 | Regan | 125/15 |
| 4,219,004 | | 8/1980 | Runyon | 125/15 |
| 4,334,895 | | 6/1982 | Keat | 51/309 |
| 4,362,535 | | 12/1982 | Isobe et al. | 51/309 |
| 4,378,233 | | 3/1983 | Carver | 51/298 |
| 4,471,026 | | 9/1984 | Nicholas et al. | 428/450 |
| 4,534,773 | | 8/1985 | Phaal et al. | 51/293 |
| 4,591,364 | * | 5/1986 | Phaal | 51/309 |
| 4,624,237 | | 11/1986 | Inoue | 125/15 |
| 4,655,795 | | 4/1987 | Bleecker et al. | 51/309 |
| 4,671,021 | | 6/1987 | Takahashi et al. | 51/204 |
| 4,685,440 | | 8/1987 | Owens | 125/11 |
| 4,798,026 | * | 1/1989 | Cerceau | 51/204 |
| 4,951,427 | | 8/1990 | St. Pierre | 51/293 |
| 5,102,621 | | 4/1992 | Sara | 420/470 |
| 5,104,424 | * | 4/1992 | Hickory et al. | 51/309 |
| 5,313,742 | | 5/1994 | Corcoran, Jr. et al. | 51/206 |
| 5,385,591 | | 1/1995 | Ramanath et al. | 51/309 |
| 5,505,750 | | 4/1996 | Andrews | 51/309 |
| 5,512,235 | * | 4/1996 | Cerutti et al. | 419/10 |
| 5,573,447 | * | 11/1996 | Kozakai et al. | 451/41 |
| 5,791,330 | | 8/1998 | Tselesin | 125/15 |
| 5,832,360 | | 11/1998 | Andrews et al. | 428/552 |
| 5,846,269 | | 12/1998 | Shiue et al. | 51/295 |
| 5,855,314 | | 1/1999 | Shiue et al. | 228/124.5 |
| 6,012,977 | * | 1/2000 | Yoshikawa et al. | 451/541 |

FOREIGN PATENT DOCUMENTS

| | | |
|---|---|---|
| 1086509 | 7/1977 | (CA) . |
| 8229825 | 2/1995 | (JP) . |
| 8229826 | 2/1995 | (JP) . |

OTHER PUBLICATIONS

K. Subramanian, T. K. Puthanangady, S. Liu, "Diamond Abrasive Finishing Of Brittle Materials An Overview," Supertech Superabrasives Technology, 1996, World Grinding Technology Center, Norton Company, Worcester, MA, pp. Cover sheet–25.

Stasyuk, L.F.; Kizikov, E.D.; Kushtalova, I.P.; "Structure and Properties of a Diamond–Containing Composition Material with a Tungsten–Free Matrix for a Truing Tool", *Metal Science and Heat Treatment, v 28 n* Nov.–Dec. 1986 P 835–839.

Mathewson, W.F.; Ratterman, E.; Gillis, K.H.; "An Analysis of the Coated Diamond/Bond System" Diamond Business Section, General Electric, Detroit, Michigan.

Kushtalova, I.P.:Stasyuk, L.F.; Kizikov, E.D.; "Development of a Diamond Containing Materials With a Tungsten–Free Matrix for Dressing Tools", *Soviet Journal of Superhard Materials v 8 n 1*, Nov., 1986, pp. 48–51.

* cited by examiner

*Primary Examiner*—William Hong
(74) *Attorney, Agent, or Firm*—Mary E. Porter

(57) ABSTRACT

A straight, thin, monolithic abrasive wheel formed of hard and rigid abrasive grains and a sintered bond including a metal component and an active metal component exhibits superior stiffness. The metal component can be selected from among many sinterable metal compositions. The active metal is a metal capable of reacting to form a bond with the abrasive grains at sintering conditions and is present in an amount effective to integrate the grains and sintered bond into a grain-reinforced composite. A diamond abrasive, copper/tin/titanium sintered bond abrasive wheel is preferred. Such a wheel is useful for abrading operations in the electronics industry, such as cutting silicon wafers and alumina-titanium carbide pucks. The stiffness of the novel abrasive wheels is higher than conventional straight monolithic wheels and therefore improved cutting precision and less chipping can be attained without increase of wheel thickness and concomitant increased kerf loss.

18 Claims, No Drawings

SUPERABRASIVE WHEEL WITH ACTIVE BOND

FIELD OF THE INVENTION

This invention relates to thin abrasive wheels for abrading very hard materials such as those utilized by the electronics industry.

BACKGROUND AND SUMMARY OF THE INVENTION

Abrasive wheels which are both very thin and highly stiff are commercially important. For example, thin abrasive wheels are used in cutting off thin sections and in performing other abrading operations in the processing of silicon wafers and so-called pucks of alumina-titanium carbide composite in the manufacture of electronic products. Silicon wafers are generally used for integrated circuits and alumina-titanium carbide pucks are utilized to fabricate flying thin film heads for recording and playing back magnetically stored information. The use of thin abrasive wheels to abrade silicon wafers and alumina-titanium carbide pucks is explained well in U.S. Pat. No. 5,313,742, the entire disclosure of which patent is incorporated herein by reference.

As stated in the '742 patent, the fabrication of silicon wafers and alumina-titanium carbide pucks creates the need for dimensionally accurate cuts with little waste of the work piece material. Ideally, cutting blades to effect such cuts should be as stiff as possible and as thin as practical because the thinner the blade, the less waste produced and the stiffer the blade, the more straight it will cut. However, these characteristics are in conflict because the thinner the blade, the less rigid it becomes.

Industry has evolved to using monolithic abrasive wheels, usually ganged together on an arbor-mounted axle. Individual wheels in the gang are axially separated from each other by incompressible and durable spacers. Traditionally, the individual wheels have a uniform axial dimension from the wheel's arbor hole to its periphery. Although quite thin, the axial dimension of these wheels is greater than desired to provide adequate stiffness for good accuracy of cut. However, to keep waste generation within acceptable bounds, the thickness is reduced. This diminishes rigidity of the wheel to less than the ideal.

The conventional straight wheel is thus seen to generate more work piece waste than a thinner wheel and to produce more chips and inaccurate cuts than would a stiffer wheel. The '742 patent sought to improve upon performance of ganged straight wheels by increasing the thickness of an inner portion extending radially outward from the arbor hole. It was disclosed that a monolithic wheel with a thick inner portion was stiffer than a straight wheel with spacers. However, the '742 patent wheel suffers from the drawback that the inner portion is not used for cutting, and therefore, the volume of abrasive in the inner portion is wasted. Because thin abrasive wheels, especially those for cutting alumina-titanium carbide, employ expensive abrasive substances such as diamond, the cost of a '742 patent wheel is high compared to a straight wheel due to the wasted abrasive volume.

It is desirable to have a straight, monolithic, thin abrasive wheel having enhanced rigidity compared to conventional wheels. Aside from wheel geometry, rigidity is determined by the intrinsic stiffness of the materials of wheel construction. Monolithic wheels are made up basically of abrasive grains and a bond which holds the abrasive grains in the desired shape. Heretofore, a metal bond normally has been used for thin abrasive wheels intended for cutting hard materials such as silicon wafers and alumina-titanium carbide pucks. A variety of metal bond compositions for holding diamond grains, such as copper, zinc, silver, nickel, or iron alloys, for example, are known in the art. It now has been discovered that addition of at least one active metal component to a metal bond composition can cause the diamond grains to chemically react with the active metal component during bond formation thereby forming an integrated, grain-reinforced composite. The very high intrinsic stiffness of the grains together with the chemical bond of the grains to the metal thus produce a substantially increased stiffness abrasive structure.

Accordingly, the present invention provides an abrasive wheel comprising a straight, monolithic, grain-reinforced abrasive disk having a uniform width in the range of about 20–2,500 $\mu$m, consisting essentially of about 2.5–50 vol. % abrasive grains and a complemental amount of a bond comprising a metal component and an active metal which forms a chemical bond with the abrasive grains on sintering, the active metal being present in an amount effective to produce an elastic modulus of the grain-reinforced abrasive disk at least 10% higher than the elastic modulus of a sintered disk of same composition but free of active metal.

There is also provided a method of cutting a work piece comprising the step of contacting the work piece with an abrasive wheel comprising a straight, monolithic, grain-reinforced abrasive disk having a uniform width in the range of about 20–2,500 $\mu$m, consisting essentially of about 2.5–50 vol. % abrasive grains and a complemental amount of a bond comprising a metal component and an active metal which forms a chemical bond with the abrasive grains on sintering, the active metal being present in an amount effective to produce an elastic modulus of the grain-reinforced abrasive disk at least 10% higher than the elastic modulus of a sintered disk of same composition but free of active metal.

Further this invention provides a method of making an abrasive tool comprising the steps of (a) providing preselected proportions of particulate ingredients comprising
  (1) abrasive grains;
  (2) a metal component consisting essentially of a major fraction of copper and a minor fraction of tin; and
  (3) an active metal which can form a chemical bond with the abrasive grains on sintering;

(b) mixing the particulate ingredients to form a uniform composition;

(c) placing the uniform composition into a mold of preselected shape;

(d) compressing the mold to a pressure in the range of about 345–690 MPa for a duration effective to form a molded article;

(e) heating the molded article to a temperature in the range of about 500–900° C. for a duration effective to sinter the metal component and active metal to a sintered bond, thereby integrating the abrasive grains and sintered bond into a grain-reinforced composite; and (f) cooling the grain-reinforced composite to form the abrasive tool.

DETAILED DESCRIPTION

The present invention can be applied to straight, circular, monolithic abrasive wheels. The term "straight" means that the axial thickness of the wheel is uniform at all radii from the radius of the arbor hole to the outer radius of the wheel. An important application intended for these wheels is slicing thin sections such as wafers and pucks of inorganic substances with precision and reduced kerf loss. Often superior results are achieved by operating the wheel at high cutting speeds, i.e., velocity of the abrasive surface in contact with the work piece. Such performance criteria and operating conditions are usually attained using wheels of extremely small, uniform thickness and large diameter. Hence, preferred wheels of this invention prominently feature a characteristically high aspect ratio . Aspect ratio is defined as the ratio of the outer diameter of the wheel divided by the axial cross section dimension, that is, the thickness of the wheel. The aspect ratio should be about 20–6000, preferably about 100–1200, and more preferably, about 250–1200 to 1.

The uniformity of wheel thickness is held to a tight tolerance to achieve desired cutting performance. Preferably, the uniform thickness is in the range of about 20–2,500 μm, more preferably, about 100–500 μm, and most preferably, about 100–200 μm. Variability in thickness of less than about 5 μm is preferred. Typically, the diameter of the arbor hole is about 12–90 mm and the wheel diameter is about 50–120 mm.

The term "monolithic" means that the abrasive wheel material is a uniform composition completely from the radius of the arbor hole to the radius of the wheel. That is, basically the whole body of the monolithic wheel is an abrasive disk comprising abrasive grains embedded in a sintered bond. The abrasive disk does not have an integral, non-abrasive portion for structural support of the abrasive portion, such as a metal core on which the abrasive portion of a grinding wheel is affixed, for example.

Basically, the abrasive disk of this invention comprises three ingredients, namely, abrasive grains, a metal component and an active metal component. The metal component and the active metal together form a sintered bond to hold the abrasive grains in the desired shape of the wheel. The sintered bond is achieved by subjecting the components to suitable sintering conditions. The term "active metal" means an element or compound that is capable of reacting with the surface of the abrasive grains on sintering. Hence, the active metal chemically bonds to abrasive grains. Furthermore, the active metal is present in an amount effective to integrate the grains and sintered bond into a grain-reinforced composite. Consequently, by judiciously choosing suitably high rigidity as well as high hardness abrasive grains, the overall stiffness of the abrasive-sintered bond matrix is enhanced by the active metal component chemically bonding to the abrasive grains during sintering.

A primary consideration for selecting the abrasive grain is that the abrasive substance should be harder than the material to be cut. Usually the abrasive grains of thin abrasive wheels will be selected from very hard substances because these wheels are typically used to abrade extremely hard materials such as alumina-titanium carbide. As mentioned, it is important that the abrasive substance also should have a sufficiently high rigidity to reinforce the structure of the bond. This additional criterion for selection of the abrasive substance normally devolves to assuring that the elastic modulus of the abrasive substance is higher, and preferably, significantly higher than that of the sintered bond. Representative hard abrasive substances for use in this invention are so-called superabrasives such as diamond and cubic boron nitride, and other hard abrasives such as silicon carbide, fused aluminum oxide, microcrystalline alumina, silicon nitride, boron carbide and tungsten carbide. Mixtures of at least two of these abrasives can also be used. Diamond is preferred.

The abrasive grains are usually utilized in fine particle form. The particle size of the grains for wheels of up to about 120 mm diameter generally should be in the range of about 0.5–100 μm, and preferably, about 10–30 μm. The grains size for wheels of larger diameter can be proportionately larger.

The metal component of this invention can be a single metal element or a mixture of multiple elements. Representative elements suitable for use in this invention include copper, tin, cobalt, iron, nickel, silver, zinc, antimony and manganese. Examples of mixtures include copper-tin, copper-tin-iron-nickel, copper-zinc-silver, copper-nickel-zinc, copper-nickel-antimony. Metal compounds such as cobalt-tungsten carbide, and nickel-copper-antimony-tantalum carbide, and alloys containing non-metals can also be used. The non-metallic component typically enhances hardness of the metal or depresses the metal melting temperature, which helps lower sintering temperature and thereby avoids damage of diamond from exposure to high temperatures. Examples of such non-metal-containing compounds and alloys include nickel-copper-manganese-silicon-iron, and nickel-boron-silicon, The metal component generally is provided as a small particle size powder. The powder particles of a multiple element metal component can either be of individual elements, pre-alloys or a mixture of both.

Due to the active metal component, the sintered bond chemically attaches to the abrasive grains rather than merely embraces them. Hence, the grains of the novel, actively bonded, thin abrasive wheel can be presented to the work piece with greater exposure than could grains of non-actively bonded wheels. Additionally, softer sintered bond compositions can be used. These features provide the advantage that the wheel will cut more freely with less tendency to load, and therefore, to operate at reduced power consumption. Copper-tin is a preferred composition for a metal component that produces a relatively soft bond.

For a metal component of copper-tin, generally a major fraction (i.e., >50 wt %) is copper and a minor fraction (i.e., <50 wt %) is tin. Preferably the copper-tin composition consists essentially of about 50–90 wt % copper and about 1040 wt % tin; more preferably, about 70–90 wt % copper and about 10–30 wt % tin; and most preferably about 70–75 wt % copper and 25–30 wt % tin. As the below description of the preparation of the novel actively bonded thin abrasive wheels will explain, the metal component is usually supplied to the wheel manufacturing process in fine particle form.

The active metal component is chosen for compatibility with both the metal component of the sintered bond and the abrasive grains. That is, under sintering conditions, the active metal should densify with the metal component to form a strong sintered bond, and it should react with the surface of the abrasive grains to form a chemical bond therewith. Selection of the active metal component can depend largely on the composition of the metal component, the composition of the abrasive grains, and sintering conditions. Representative materials for the active metal component are titanium, zirconium, hafnium, chromium, tantalum and mixtures of at least two of them. In a mixture, the active component metals can be supplied as individual metal particles or as alloys. Titanium is preferred, especially in connection with copper-tin metal component and diamond abrasive.

The active component can be added either in elemental form or as a compound of metal and non-active component elements. Elemental titanium reacts with water and or oxygen at low temperature to form titanium dioxide and thus becomes unavailable to react with abrasive during sintering. Therefore, adding elemental titanium is less preferred when water or oxygen is present. If titanium is added in compound form, the compound should be capable of dissociation to elemental form prior to the sintering step to permit the titanium to react with the abrasive. A preferred compound form of titanium for use in this invention is titanium hydride, $TiH_2$, which is stable up to about 500° C. Above about 500° C., titanium hydride dissociates to titanium and hydrogen.

Both the metal component constituents and active metal components preferably are incorporated into the bond composition in particle form. The particles should have a small particle size to help achieve a uniform concentration throughout the sintered bond and optimum contact with the abrasive grains during sintering, and to develop good bond strength to the grains. Fine particles of maximum dimension of about 44 $\mu$m are preferred. Particle size of the metal powders can be determined by filtering the particles through a specified mesh size sieve. For example, nominal 44 $\mu$m maximum particles will pass through a 325 U.S. standard mesh sieve.

In a preferred embodiment, the actively bonded thin abrasive wheel comprises sintered bond of about 45–75 wt % copper, about 20–35 wt % tin and about 5–20 wt % active metal, the total adding to 100 wt %. In a particularly preferred embodiment, the active metal is titanium. As mentioned, preference is given to incorporating the titanium component in the form of titanium hydride. The slight difference between the molecular weight of elemental titanium and titanium hydride usually can be neglected. However, for sake of clarity it is noted that the compositions stated herein refer to the titanium present, unless specifically indicated otherwise.

The novel abrasive wheel is basically produced by a densification process of the so-called "cold press" or "hot press" types. In a cold press process, occasionally referred to as "pressureless sintering", a blend of the components is introduced into a mold of desired shape and a high pressure is applied at room temperature to obtain a compact but friable molded article. Usually the high pressure is above about 300 MPa. Subsequently, pressure is relieved and the molded article is removed from the mold then heated to sintering temperature. The heating for sintering normally is done while the molded article is pressurized in an inert gas atmosphere to a lower pressure than the pre-sintering step pressure, i.e., less than about 100 MPa, and preferably less than about 50 MPa. Sintering can also take place under vacuum. During this low pressure sintering, the molded article, such as a disk for a thin abrasive wheel, advantageously can be placed in a mold and/or sandwiched between flat plates.

In a hot press process, the blend of particulate bond composition components is put in the mold, typically of graphite, and compressed to a high pressure as in the cold process. However, an inert gas is utilized and the high pressure is maintained while the temperature is raised thereby achieving densification while the preform is under pressure.

An initial step of the abrasive wheel process involves packing the components into a shape forming mold. The components can be added as a uniform blend of separate abrasive grains, metal component constituent particles and active metal component constituent particles. This uniform blend can be formed by using any suitable mechanical blending apparatus known in the art to blend a mixture of the grains and particles in preselected proportion. Illustrative mixing equipment can include double cone tumblers, twin-shell V-shaped tumblers, ribbon blenders, horizontal drum tumblers, and stationary shell/internal screw mixers.

The copper and tin can be pre-alloyed and introduced as bronze particles. Another option includes combining and then blending to uniformity a stock bronze particulate composition, additional copper and/or tin particles, active metal particles and abrasive grains.

In a basic embodiment of the invention, the abrasive grains are uncoated prior to sintering the bond. That is, the abrasive grains are free of metal on their surface. Another embodiment calls for pre-coating the abrasive grains with a layer comprising all or a portion of the active metal component prior to mechanically blending all of the components. This technique can enhance chemical bond formation between abrasive grains and active metal during sintering.

The layer can be of molecular thickness, for example as can be obtained by chemical vapor deposition or physical vapor deposition, or of macromolecular thickness. If a molecular thickness is used, it is recommended to supplement the amount of active metal in the pre-coating with additional active metal in the mixture of grains and bond composition components. Usually a molecular thickness of pre-coating does not alone possess a sufficient amount of the active metal to attain the beneficial results that can be achieved by this invention.

A macromolecular thickness coating can be achieved by (A) mixing to uniform composition a fine powder of the active metal component and an effective amount of a fugitive liquid binder to form a tacky paste; (B) mixing the abrasive grains with the adhesive paste to wet at least a major fraction of the grain surface area with the adhesive paste; and (C) drying the liquid binder, usually with heat, to leave a residue of the active metal powder particles mechanically attached to the abrasive grains. The purpose of mechanical attachment is to maintain the active metal particles in proximity to the grains at least until sintering when the chemical bonding will render the attachment permanent. Any conventional fugitive liquid binder can be used for the paste. The term "fugitive" means that the liquid binder has the ability to vacate the bond composition at elevated temperature, preferably below sintering temperature and without adversely impacting the sintering process. The binder should be sufficiently volatile to substantially completely evaporate and/or pyrolyze during sintering without leaving a residue that might interfere with the function of the bond. Preferably the binder will vaporize below about 400° C. The binder can be blended with the particles by many methods well known in the art.

The mixture of components to be charged to the shape forming mold can include minor amounts of optional processing aids such as paraffin wax, "Acrowax", and zinc stearate which are customarily employed in the abrasives industry.

Once the uniform blend is prepared, it is charged into a suitable mold. In a preferred cold press sintering process, the mold contents can be compressed with externally applied mechanical pressure at ambient temperature to about 345–690 MPa. A platen press can be used for this operation, for example. Compression is usually maintained for about 5–15 seconds, after which pressure is relieved. The mold contents are next raised to sintering temperature, which should be high enough to cause the bond composition to densify but not melt substantially completely. The sintering temperature should be at least about 500° C. Heating should take place in an inert atmosphere, such as under low absolute pressure vacuum or under blanket of inert gas. It is important to select metal bond and active metal components which do not require sintering at such high temperatures that abrasive grains are adversely affected. For example, diamond begins to graphitize above about 1100° C. Therefore, sintering of diamond abrasive wheels should be designed to occur safely below this temperature, preferably below about 950° C., and more preferably below about 900° C. Sintering temperature should be held for a duration effective to sinter the bond components and to simultaneously react the active metal with the abrasive grains. Sintering temperature typically is maintained for about 30–120 minutes.

In a preferred hot press process, conditions are generally the same as for cold pressing except that pressure is maintained until completion of sintering. In either pressureless sintering or hot pressing, after sintering, the molds are lowered to ambient temperature and the sintered products are removed. The products are finished by conventional methods such as lapping to obtain desired dimensional tolerances.

The above mentioned sintering and bonding thus integrates the abrasive grains into the sintered bond so as to form a grain-reinforced composite. To facilitate formation of the grain-reinforced composite as well as to provide well exposed abrasive, it is preferred to use about 2.5–50 vol. % abrasive grains and a complemental amount of sintered bond in the sintered product.

The preferred abrasive tool according to this invention is an abrasive wheel. Accordingly, the typical mold shape is that of a thin disk. A solid disk mold can be used, in which case after sintering a central disk portion can be removed to form the arbor hole. Alternatively, an annular shaped mold can be used to form the arbor hole in situ. The latter technique avoids waste due to discarding the abrasive-laden central portion of the sintered disk.

Upon successful formation of a grain-reinforced composite structure, the abrasive grains will contribute to the stiffness of the wheel. Hence, as stated above, it is important that the abrasive be selected not only for traditional characteristics of hardness, impact resistance and the like, but also for stiffness properties as determined by elastic modulus, for example. While not wishing to be bound by a particular theory, it is believed that very rigid abrasive particles integrated into the sintered bond by virtue of chemical bonding with the active metal component contribute significantly to the stiffness of the composite. This contribution is thought to occur because stress loads on the composite during operation are effectively transferred to the intrinsically very stiff, abrasive grains. It is thus possible by practice of this invention to obtain straight, actively bonded thin abrasive wheels that are stiffer than conventional wheels of equal thickness. The novel wheels are useful for providing more precise cuts and less chipping with no further sacrifice of kerf loss relative to traditional straight wheels.

The stiffness of the novel abrasive wheel should be enhanced considerably relative to conventional wheels. In a preferred embodiment, the elastic modulus of the actively bonded abrasive wheel is higher than the elastic modulus of the sintered bond components alone (i.e., metal component plus active metal component free of abrasive grains) and also is at least about 100 GPa and preferably at least about 150 GPa. In another preferred embodiment, the elastic modulus of the wheel is at least about two times the elastic modulus of the sintered bond free of abrasive grains.

This invention is now illustrated by examples of certain representative embodiments thereof, wherein, unless otherwise indicated, all parts, proportions and percentages are by weight and particle sizes are stated by U.S. standard sieve mesh size designation. All units of weight and measure not originally obtained in SI units have been converted to SI units.

EXAMPLES

Example 1

Copper powder (<400 mesh), tin powder (<325 mesh) and titanium hydride (<325 mesh) were combined in proportions of 59.63% Cu, 23.85% Sn and 16.50% $TiH_2$. This bond composition was passed through a 165 mesh stainless steel screen to remove agglomerates and the screened mixture was thoroughly blended in a "Turbula" brand mixer (Glen Mills, Inc., Clifton, N.J.) for 30 minutes. Diamond abrasive grains (15–25 $\mu$m) from GE Superabrasives, Worthington, Ohio, were added to the metal blend to form a mixture containing 18.75 vol. % of diamond. This mixture was blended in a Turbula mixer for 1 hour to obtain a uniform abrasive and bond composition.

The abrasive and bond composition was placed into a steel mold having a cavity of 121.67 mm outer diameter, 6.35 mm inner diameter and uniform depth of 0.81 mm. A "green" wheel was formed by compacting the mold at ambient temperature under 414 MPa (4.65 tons/$cm^2$) for 10 seconds. The green wheel was removed from the mold then heated to 850° C. under vacuum for 2 hours between horizontal, flat plates with a 660 g weight set on the upper plate. The hot sintered product was permitted to gradually cool to 250° C. then it was rapidly cooled to ambient temperature. The wheel was ground to final size by conventional methods, including "truing" to a preselected run out, and initial dressing under conditions shown in Table I.

The finished wheel size was 114.3 mm outer diameter, 69.88 mm inner diameter (arbor hole diameter) and 0.178 mm thickness.

TABLE I

Truing Conditions Examples 1–2

| | |
|---|---|
| Trued Wheel | |
| Speed | 5593 rev./min. |
| Feed rate | 100 mm/min. |
| Exposure from flange | 3.68 mm |
| Truing Wheel | model no. 37C220-H9B4 |
| Composition | silicon carbide |
| Diameter | 112.65 mm |
| Speed | 3000 rev./min. |
| Traverse rate | 305 mm/min. |
| No. of passes | |
| at 2.5 $\mu$m | 40 |
| at 1.25 $\mu$m | 40 |
| Initial Dressing | |
| Wheel speed | 2500 rev./min. |
| Dressing stick | type 37C500-GV |
| Dressing stick width | 12.7 mm |
| Penetration | 2.54 mm |
| Feed rate | 100 mm/min. |
| No. of passes | 12.00 |

Example 2 and Comparative Example 1

The novel wheel manufactured as described in Example 1 and a conventional, commercially available wheel of same size (Comp. Ex. 1) were used to cut multiple slices through a 150 mm long ×150 mm wide ×1.98 mm thick block of type 3M-310 (Minnesota Mining and Manufacturing Co., Minneapolis, Minn.) alumina-titanium carbide glued to a graphite substrate.

The Comp. Ex. 1 wheel composition was 18.9 vol. % 15/25 μm diamond grains in a bond of 53.1 wt % cobalt, 23.0 wt % nickel, 12.7 wt % silver, 5.4 wt % iron, 3.4 wt % copper and 2.4 wt % zinc. Before each slice, the wheels were dressed as described in Table I except that a single dressing pass and a 19 mm width dressing stick (12.7 mm for Comp. Ex. 1) was used. In each test the abrasive wheels were mounted between two metal supporting spacers of 106.93 mm outer diameter. Wheel speed was 7500 rev./min. (9000 rev./min. for Comp. Ex. 1) and a feed rate of 100 mm/min. and cut depth of 2.34 mm were utilized. The cutting was cooled by a flow of 56.4 L/min. 5% rust inhibitor stabilized demineralized water discharged through a 1.58 mm ×85.7 mm rectangular nozzle at a pressure of 275 kPa.

Cutting results are shown in Table II. The novel wheel performed well against all cutting performance criteria. The Comp. Ex. 1 wheel needed to operate at 20% higher rotations peed and drew about 45% higher power than the novel wheel (about 520 W vs. 369 W).

TABLE II

| | Slices | | Cum. Length | Wheel Wear | | | Workpiece | | Cut Straight- | Spin Power |
|---|---|---|---|---|---|---|---|---|---|---|
| | No. | Cum. No. | sliced m | Radial μm | Cum. μm | factor[1] μm/m | Max Chip μm | Avg Chip μm | ness μm | Draw W |
| Ex. 1 | 9.00 | 9.00 | 1.35 | 5.08 | 5.08 | 3.70 | 8.00 | <5 | <5 | |
| | 9.00 | 18.00 | 2.70 | 0.00 | 5.08 | 0.00 | 9.00 | 5.00 | <5 | |
| | 9.00 | 27.00 | 4.05 | 0.00 | 5.08 | 0.00 | 11.00 | <5 | <5 | 368–296 |
| | 9.00 | 36.00 | 5.40 | 10.16 | 15.24 | 7.40 | 6.00 | <5 | <5 | |
| | 9.00 | 45.00 | 6.75 | 2.54 | 17.78 | 1.90 | 10.00 | 5.00 | <5 | |
| | 9.00 | 54.00 | 8.10 | 2.54 | 20.32 | 1.90 | 11.00 | 5.00 | <5 | 312–368 |
| | 9.00 | 63.00 | 9.45 | 10.16 | 30.48 | 7.40 | 8.00 | <5 | <5 | |
| | 9.00 | 72.00 | 10.8 | 2.54 | 33.02 | 1.90 | 9.00 | <5 | <5 | |
| | 9.00 | 81.00 | 12.0 | 2.54 | 35.56 | <0.5 | 9.00 | <5 | <5 | 376–328 |
| Comp.Ex. 1 | 9.00 | 9.00 | 1.35 | 5.08 | 5.08 | 3.70 | 11.00 | <5 | <5 | 520–536 |
| | 9.00 | 18.00 | 2.70 | 10.16 | 15.24 | 7.40 | | | | |
| | 9.00 | 27.00 | 4.05 | 5.08 | 20.32 | 3.70 | | | | |
| | 9.00 | 36.00 | 5.40 | 2.54 | 22.86 | 1.90 | 10.00 | <5 | <5 | |
| | 9.00 | 45.00 | 6.75 | 5.08 | 27.94 | 3.70 | | | | |
| | 9.00 | 54.00 | 8.10 | 2.54 | 30.48 | 1.90 | | | | |
| | 9.00 | 63.00 | 9.45 | 5.08 | 35.56 | 3.70 | 14.00 | <5 | <5 | 560–576 |

[1]Wear factor = Radial wheel wear divided by length of workpiece sliced

Examples 3 and 4, and Comparative Examples 2–8

The stiffness of grain reinforced abrasive wheel compositions was tested. A variety of fine metal powders with and without diamond grains were combined in proportions shown in Table III and mixed to composition uniformity as in Example 1. Tensile test specimens were produced by compressing the compositions in dogbone-shaped molds at ambient temperature under a pressure of about 414–620 MPa (30–45 Tons/in$^2$ ) for about 5–10 seconds and then sintered under vacuum as described in Example 1.

The test specimens were subjected to sonic and standard tensile modulus measurements on an instron tensile test machine. Results are shown in Table III. Elastic modulus of the grain reinforced samples (Ex. 3 and 4) exceeded 150 GPa. The increased concentration of diamond in Ex. 4 boosted modulus significantly which confirms that the diamond became integrated into the composition. In contrast, Comp. Ex. 2 revealed that the same bond composition without grain reinforcement due to absence of diamond dramatically reduced stiffness. Similarly, Comp. Ex. 3 demonstrates that the diamond embedded in a bronze bond composition without an active component provides relatively poor stiffness.

In Comp. Ex. 4, diamond grains formerly commercially available from General Electric Co. which were stated by the manufacturer to be surface coated with about 1–2 μm thickness of titanium were used. Stiffness improved slightly compared to having no active component present (Comp. Ex. 3), but fell far short of the operative example compositions. Suspected reasons for the reduced effectiveness are that too small amount of active component was present, that the titanium on the surface was in carbide form prior to sintering which rendered the titanium less compatible with the other metal components, and/or that non-carbide titanium on the grains was oxidized.

Comp. Exs. 5 and 7 demonstrate that conventional thin diamond wheels with different compositions of copper/tin/nickel/iron bonds have moduli of only about 100 GPa.

Comp. Exs. 6 and 8 correspond to the wheel compositions of Comp. Exs. 5 and 7 without diamond grains. These examples show that stiffness of the bond compositions either with or without diamond was about the same. This confirms the expectation that the active metal component-free bond does not integrate the diamond into the bond so as to reinforce the structure.

TABLE III

| | Ex. 3 | Ex. 4 | Comp. Ex. 2 | Comp. Ex. 3 | Comp. Ex. 4 | Comp. Ex. 5 | Comp. Ex. 6 | Comp. Ex. 7 | Comp. Ex. 8 |
|---|---|---|---|---|---|---|---|---|---|
| Copper, wt % | 59.50 | 59.50 | 59.50 | 80.00 | 80.00 | 70.00 | 70.00 | 62.00 | 62.00 |
| Tin, wt % | 24.00 | 24.00 | 24.00 | 20.00 | 20.00 | 9.10 | 9.10 | 9.20 | 9.20 |
| Titanium, wt % | 16.50 | 16.50 | 16.50 | | | | | | |
| Nickel, wt % | | | | | | 7.50 | 7.50 | 15.30 | 15.30 |
| Iron, wt % | | | | | | 13.40 | 13.40 | 13.50 | 13.50 |
| Diamond, vol. % | 18.80 | 30.00 | | 18.80 | 18.8* | 18.80 | | 18.80 | |
| Sonic Modulus, GPa | 176.00 | 220.00 | | 67.00 | 80.00 | 95.00 | | 99.00 | |
| Tensile Modulus, GPa | 276.00 | | 110.00 | 60.00 | 84.00 | | 106.00 | 103.00 | 95.00 |

*diamond coated with ca. 1–2 μm titanium

Although specific forms of the invention have been selected for illustration in the examples, and the preceding description is drawn in specific terms for the purpose of describing these forms of the invention, this description is not intended to limit the scope of the invention which is defined in the claims.

What is claimed is:

1. An abrasive wheel comprising a straight, grain-reinforced abrasive disk having a uniform width in the range of about 20–2,500 μm, consisting essentially of about 2.5–50 vol. % abrasive grains and a complemental amount of a metal bond comprising a metal component and an active metal which forms a chemical bond with the abrasive grains on sintering, the active metal and abrasive grains being present in an amount effective to produce a grain-reinforced abrasive disk having an elastic modulus value at least 10% higher than the elastic modulus value of an abrasive disk of same composition but free of active metal.

2. The abrasive wheel of claim 1 in which the abrasive grains are about 0.5–100 μm in size and the grain-reinforced abrasive disk has an elastic modulus value of at least about 100 GPa.

3. The abrasive wheel of claim 2 in which the elastic modulus value is at least about twice as high as the elastic modulus value of the same sintered bond composition free of abrasive grains.

4. The abrasive wheel of claim 3 in which the abrasive disk consists essentially of about 15–30 vol. % of abrasive grains.

5. The abrasive wheel of claim 4 in which the active metal is selected from the group consisting of titanium, zirconium, hafnium, chromium, tantalum, and a mixture of at least two of them.

6. The abrasive wheel of claim 5 in which the abrasive grains are free of active metal coating.

7. The abrasive wheel of claim 5 in which the abrasive grains are coated with a macromolecular thickness layer of metal.

8. The abrasive of claim 1 in which the metal component comprises a metal alloy or metal compound containing a material selected from the group consisting of boron, silicon, and compounds and combinations thereof.

9. The abrasive wheel of claim 1 which is monolithic.

10. The abrasive wheel of claim 1 in which the metal component is selected from the group consisting of copper, tin, cobalt, iron, nickel, silver, zinc, antimony, manganese, metal carbide and alloys of at least two of them.

11. The abrasive wheel of claim 10 in which the sintered bond comprises (a) about 45–75 wt % copper;

(b) about 20–35 wt % tin; and (c) about 5–20 wt % active metal in which the total of (a), (b) and (c) is 100 wt %.

12. The abrasive wheel of claim 11 in which the active metal is selected from the group consisting of titanium, zirconium, hafnium, chromium, tantalum, and a mixture of at least two of them.

13. The abrasive wheel of claim 12 in which the active metal is titanium.

14. The abrasive wheel of claim 1 in which abrasive grains are of an abrasive selected from the group consisting of diamond, cubic boron nitride, silicon carbide, fused aluminum oxide, microcrystalline alumina, silicon nitride, boron carbide, tungsten carbide and mixtures of at least two of them.

15. The abrasive wheel of claim 14 in which the abrasive grains are diamond.

16. The abrasive wheel of claim 1 consisting essentially of the abrasive disk which has a circumferential rim of diameter of about 40–120 mm, which defines an axial arbor hole of about 12–90 mm, which has uniform width in the range of about 100–500 μm and which consists essentially of diamond grains and a sintered bond comprising about 59.5 wt % copper, 24 wt % tin and 16.5 wt % titanium.

17. The abrasive wheel of claim 16 in which the uniform width is in the range of about 100–200 μm.

18. An abrasive wheel comprising a straight, grain-reinforced abrasive disk having a uniform width and an aspect ratio of about 20–6000 to 1, consisting essentially of about 2.5–50 vol. % abrasive grains and a complemental amount of a bond comprising a metal component and an active metal which forms a chemical metal bond with the abrasive grains on sintering, the active metal and abrasive grains being present in an amount effective to produce a grain-reinforced abrasive disk having an elastic modulus value at least 10% higher than the elastic modulus value of an abrasive disk of same composition but free of active metal.

* * * * *